US007846286B2

(12) United States Patent
Gelli

(10) Patent No.: US 7,846,286 B2
(45) Date of Patent: Dec. 7, 2010

(54) DEVICE AND METHOD FOR CLOSING THE TAIL END OF LOGS OF WEB MATERIAL AND RELATIVE LOGS OBTAINED THEREWITH

(75) Inventor: Mauro Gelli, Lucca (IT)

(73) Assignee: Fabio Perini, S.p.A., Lucca (IT)

( * ) Notice: Subject to any disclaimer, the term of this patent is extended or adjusted under 35 U.S.C. 154(b) by 612 days.

(21) Appl. No.: 11/794,091

(22) PCT Filed: Dec. 27, 2005

(86) PCT No.: PCT/IT2005/000766

§ 371 (c)(1),
(2), (4) Date: Jun. 25, 2007

(87) PCT Pub. No.: WO2006/070431

PCT Pub. Date: Jul. 6, 2006

(65) Prior Publication Data

US 2008/0083521 A1 Apr. 10, 2008

(30) Foreign Application Priority Data

Dec. 28, 2004 (IT) ..... FI2004A0273

(51) Int. Cl.
*B32B 37/00* (2006.01)

(52) U.S. Cl. ..... 156/184; 156/187; 156/227; 156/443

(58) Field of Classification Search ..... 156/184, 156/187, 227, 443, 351
See application file for complete search history.

(56) References Cited

U.S. PATENT DOCUMENTS

| | | | | |
|---|---|---|---|---|
| 3,172,612 | A | 3/1965 | Besserdich | |
| 3,912,571 | A * | 10/1975 | Hartbauer et al. | 156/351 |
| 5,242,525 | A | 9/1993 | Biagiotti | |
| 5,681,421 | A | 10/1997 | Biagiotti | |
| RE35,729 | E | 2/1998 | Biagiotti | |
| 5,716,489 | A | 2/1998 | Biagiotti | |
| 6,050,519 | A | 4/2000 | Biagiotti | |
| 6,143,111 | A | 11/2000 | Biagiotti | |
| 6,168,679 | B1 | 1/2001 | Biagiotti | |
| RE37,039 | E | 2/2001 | Biagiotti | |
| 6,682,623 | B1 * | 1/2004 | Biagiotti | 156/187 |
| 6,882,623 | B1 | 4/2005 | Goren et al. | |
| 2004/0206445 | A1 | 10/2004 | Butterworth et al. | |
| 2007/0095461 | A1 * | 5/2007 | Redmann et al. | 156/227 |

FOREIGN PATENT DOCUMENTS

| | | | |
|---|---|---|---|
| DE | 195 28 264 | A1 | 4/1996 |
| EP | 0 742 169 | A2 | 11/1996 |
| EP | 0 742 169 | A3 | 11/1997 |
| JP | 2001-120459 | * | 5/2001 |

OTHER PUBLICATIONS

Translation of German Patent 19528264, no date.*
Translation of Japaense Patent 2001-120459, no date.*

* cited by examiner

*Primary Examiner*—Jeff H Aftergut
(74) *Attorney, Agent, or Firm*—Breiner & Breiner, L.L.C.

(57) ABSTRACT

The device comprises a system for unwinding a portion of the web material from the log R, and a system for rewinding the tail end on the log after application of an adhesive. Moreover, a folding member 21 is provided, to fold the tail end and form a fold of web material defining a portion for gripping and detaching the folded loose end from the roll.

38 Claims, 12 Drawing Sheets

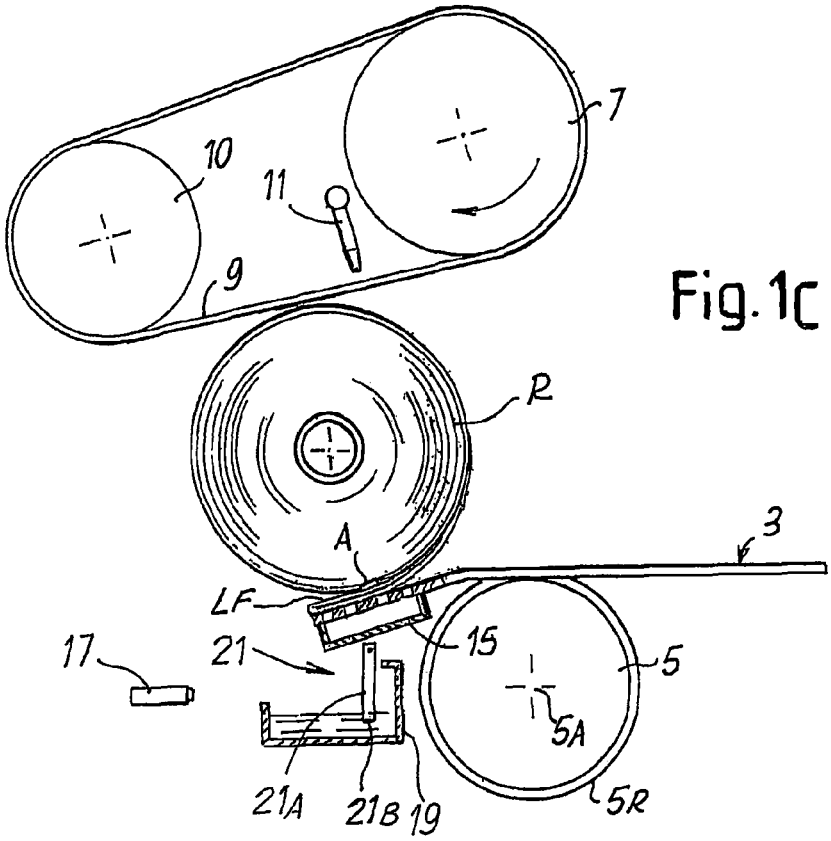
Fig. 1C
Fig. 1D
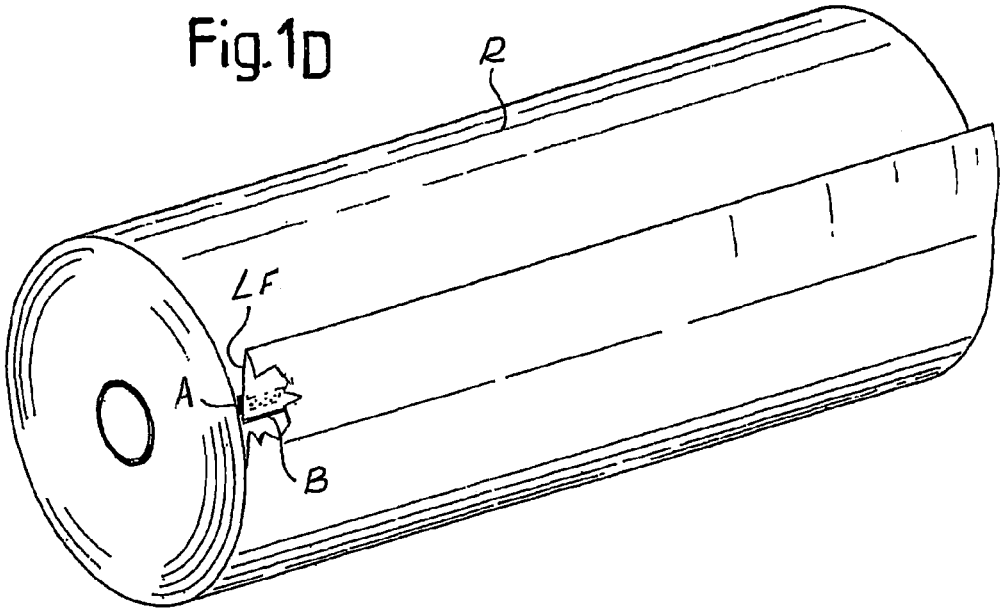

DEVICE AND METHOD FOR CLOSING THE TAIL END OF LOGS OF WEB MATERIAL AND RELATIVE LOGS OBTAINED THEREWITH

TECHNICAL FIELD

The present invention relates to improvements to methods and devices to close, by gluing or adhesion, the tail end of rolls or logs of wound web material, such as logs of tissue paper to produce kitchen towels, toilet paper or the like.

STATE OF THE ART

In the production of toilet paper, kitchen towels and other products made of absorbent paper or tissue paper for domestic or industrial use, a predetermined quantity of web material is wound into individual logs. The web material is usually delivered from reels of large diameter produced in paper mills. The logs of smaller diameter, which are produced in the rewinding machines, are optionally then divided into rolls of smaller axial length, i.e. of dimensions equivalent to the finished product that is subsequently packaged and distributed to the consumer. Once the log has been produced in the rewinding machine, the loose tail end of the wound web material must be glued or in any case made to adhere to the log or roll in order to facilitate subsequent handling through the various production steps till final packaging. If this were not performed the logs could become accidentally unwound and obstruct the subsequent converting operations performed before they are packaged.

Various device and methods to perform gluing of the tail end of logs of web material have been studied; this operation has some critical aspects as, among other things, sufficiently efficacious seal of the loose end must be guaranteed in order to prevent obstacles during the subsequent process steps, while at the same time easy detachment of the loose end by the final user of the roll must also be guaranteed. Machines and methods to perform gluing of the loose tail end of logs of web material are described in the patents USA No. RE 37039, RE 35729, U.S. Pat. Nos. 5,242,525, 5,716,489, 6,143,111, 5,681,421, 6,050,519, 6,682,623 and in other patents pertaining to the same technological sector.

OBJECTS AND SUMMARY OF THE INVENTION

The object of the present invention is to provide a device and a method for gluing the loose tail end of logs or rolls of web material, which on the one hand allow efficient gluing and on the other facilitate the subsequent step to open the roll by the final user.

The object of a preferred embodiment of the invention is to produce a method and a device which make it possible to obtain gluing with which subsequent opening of the loose end of the roll is facilitated, without tearing of the web material forming the first turn wound on the roll.

In substance, a first aspect of the invention provides for a method to close the tail end of a log of web material using an adhesive, comprising the steps of: unwinding a portion of the web material from the log; applying the adhesive; rewinding the portion of web material to make the tail end adhere to the log. Characteristically, the tail end is folded before being rewound on the log thereby forming a fold of web material, which forms a portion for gripping and detaching the web material from the roll at the time of use. This gripping and detaching area has a double thickness with respect to the web material, having been obtained by folding of the tail end and therefore has increased consistency and strength.

In substance, a folded portion of web material is formed to define a double end to facilitate grip and opening the roll by the final user.

According to an advantageous embodiment, the folded tail end forms a fold of web material, which projects beyond the adhesive when the tail end has been rewound on the log.

In general, the tail end can be folded outwards, i.e. so that the terminal edge of the web material is on the outer surface of the closed log. Nonetheless, according to the preferred embodiment of the invention, the tail end is folded on the inner surface of the unwound portion of the web material, so that the terminal edge of the tail end is positioned inside the last turn of web material wound on the log. This inward folding of the tail end further facilitates opening of the log, as the risk of the first turn of web material tearing due to incomplete detachment from the subsequent turn is reduced substantially.

The adhesive, which is used to close the loose end, preferably although not necessarily a liquid adhesive, is applied in proximity to the terminal edge of the tail end. Preferably, the adhesive is applied in proximity to the terminal edge of said end, on the surface of the material, which, after rewinding of the tail portion of web material, comes into contact with the outer surface of the log. However, in a per se known way, it would also be possible for the adhesive to be applied, after having partially unwound a quantity of web material exceeding the length of one turn, to the outer surface of the log, i.e. to a portion of the web material still wound on the log. In this case, after folding the loose end, the web material is rewound to cover the adhesive applied to the back of the log.

The adhesive is preferably applied as close as possible to the terminal edge of the loose end, i.e. as close as possible to the position that this edge takes after folding of the loose tail end. In a possible embodiment of the invention, the adhesive is applied exactly corresponding to the terminal edge of the folded loose end, so that it projects in part on one side and in part on the other side with respect to the terminal edge of the end.

In a modified embodiment of the invention, the adhesive can be in the form of a double-sided adhesive tape, although it is preferable to use an adhesive in the form of liquid glue. If the adhesive is in liquid form, it can be picked up, in a per se known way, by a movable dispensing element, which picks up the liquid adhesive from a reservoir or container and applies it to the desired point on the surface of the web material. In a possible embodiment of the invention, the movable dispensing element is also used to perform folding of the tail end, in order to reduce the movable members required to perform the operations to close the tail end.

Although it is preferable for the adhesive to be applied at a certain distance from the folding line of the loose tail end, in order to keep a portion of folded web material projecting from the gluing line, to facilitate grip it would also be possible to distribute glue or adhesive up to the folding line according to a continuous line or in stretches, due to the form of the dispenser or the operating mode thereof, as will be explained hereunder.

The adhesive can be applied according to a continuous line, or according to a discontinuous line, or yet again also in one or two points close to the fold of the loose tail end, to leave stretches of material loose and easily gripped by the fingers of the user at the time the roll is opened, when it is used for the first time.

According to a different aspect, the invention relates to a device for closing the tail end of logs of web material, comprising a system for unwinding a portion of web material from the log and a system for rewinding the tail end on the log after the adhesive has been applied, and a folding member to fold the tail end and form a fold of web material adjacent to the adhesive after the tail end has been rewound and made to adhere to the log.

Further advantageous characteristic embodiments of the method and of the device according to the invention are indicated in the appended claims.

The invention also relates to a log of wound web material, with a tail end fastened by means of an adhesive to the surface of the log, wherein said tail end is folded and forms a fold defining a portion for gripping and detaching the folded end from the log. This portion has double thickness compared to the thickness of the base web material.

Further characteristics and embodiments of the log, according to the invention, are indicated in the appended claims.

BRIEF DESCRIPTION OF THE DRAWINGS

The invention will be better understood following the description of the accompanying drawing, which shows non-limiting practical embodiments of the invention. More specifically, in the drawing, where the same parts are indicated with the same reference numeral:

FIGS. 1A, 1B and 1C show, in schematic side views, three steps to apply the adhesive to the folded loose tail end of a log in a first embodiment;

FIG. 1D shows an enlarged perspective view of the log obtained with the method illustrated in FIGS. 1A, 1B and 1C;

DETAILED DESCRIPTION OF PREFERRED EMBODIMENTS OF THE INVENTION

Figure 1A:
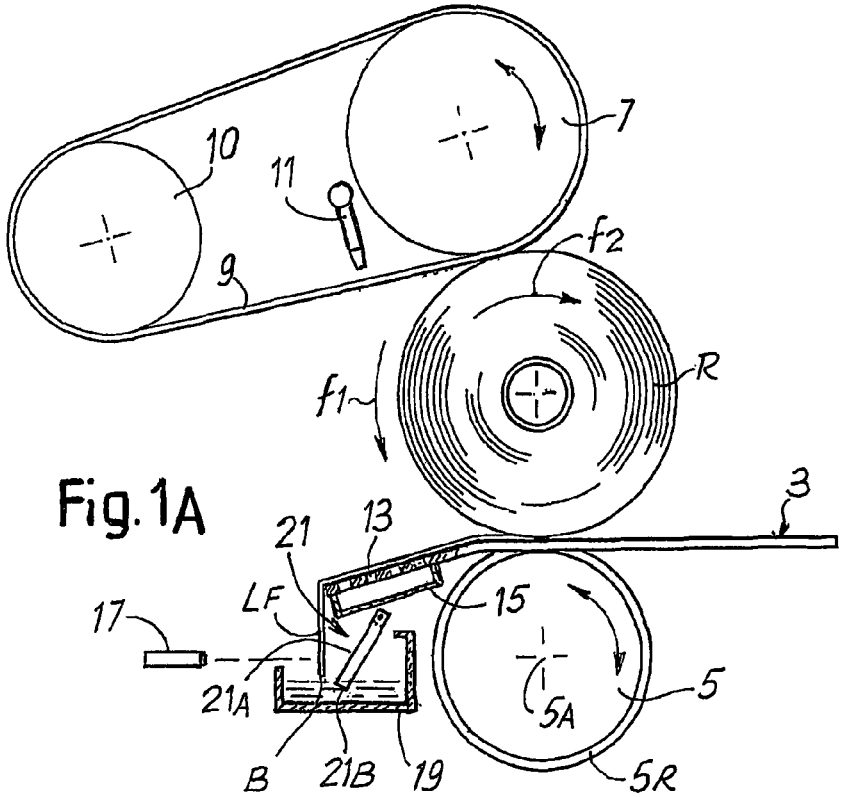

A first embodiment of the invention is represented in side view and in axonometric view in FIGS. 1A to 2C. In this embodiment, the device to close the tail end of the log R substantially comprises a supporting and rolling surface 3 on which the log R is fed in a per se known way, not shown, e.g. by a rotary butterfly distributor.

Positioned in the final area of the supporting and rolling surface 3 is a lower roller 5 with an axis 5A located below said surface. The roller 5 has annular raised portions 5R (see in particular FIGS. 2A, 2B and 2C), which project through profiles 3A, which define the supporting surface 3. In this way the surface of the roller 5 projects partially beyond the supporting surface 3 in order to come into contact with the log R.

Positioned above the surface 3 is a roller 7, driven about which is a flexible member composed of a series of belts 9. Besides being entrained around the roller 7, the belts are entrained around a further roller 10 parallel to the roller 7. At least one of the two rollers 7, 10 is motorized. The assembly formed of the belts 9 and of the rollers 7, 10 can be supported in an adjustable way, to set the distance of the belts 9 with respect to the supporting surface 3, as a function of the diameter of the logs to be glued.

The distance between the roller 7 with the belts 9 and the roller 5 is such that a log R can be inserted between these members, in contact with the annular raised portions 5R of the roller 5 and the belts 9. In this way it is possible to retain the log R in a controlled position and make it rotate in the desired direction to control opening and positioning of the tail end of said log, allowing the subsequent gluing operations.

Associated with the roller 7 are a series of nozzles 11 aligned parallel to the axis of the rollers 5, 7 and 10 and oriented towards the surface of the log R when this comes to be positioned between the rollers 5 and 7. In the example shown in FIGS. 1 and 3, below the nozzles 11 the supporting surface 3 is tilted downwards and is equipped with a series of suction holes 13 in connection with a suction box 15 below. Positioned beyond the end area of the supporting surface 3 is a photocell 17 or another suitable sensor to detect in a per se known way the presence of the loose tail end unwound from the log R.

Also positioned under the tilted end portion of the supporting surface 3 is a container 19 of adhesive in the form of a liquid glue, inside which a movable applicator element can be immersed, said element indicated as a whole with 21 and composed of a pair of arms 21A supporting a rectilinear member 21B, such as a wire or a bar which is immersed in the liquid adhesive contained in the container 19.

Operation of the device described hereinbefore is as follows. A log R is fed along the supporting and rolling surface 3 and takes the position shown in FIG. 1A, in contact inferiorly with the annular raised portions 5R of the roller 5 and superiorly with the belts 9 driven around the roller 7. It is then made to rotate in the direction of winding, according to the arrow f1, so that the loose tail end thereof passes in front of the nozzles 11, which generate jets of air directed tangentially against the surface of the log R. This allows the loose tail end to be opened by the jets of air and take the position indicated with LF in FIG. 1A. In this position the end LF projects downwards beyond the end portion of the supporting and rolling surface 3. If the portion of web material unwound from the log R is sufficiently long, the loose tail end LF intercepts the beam of the photocell 17 (e.g. normally reflected from a reflecting surface lying behind or from the surface of the lower roller 5 itself).

In this situation, the log R is made to continue to rotate in the rewinding direction f1 until the photocell 17 detects the terminal edge B of the loose end LF and gives the command to stop rotation of the rollers 5 and 7 and therefore of the belts 9. If after opening of the loose tail end LF by the nozzles 11 the portion of unwound web material is not sufficiently long to intercept the beam of the photocell 17, the direction of rotation of the rollers 7 and 5 would be reversed to cause unwinding of the log R according to the arrow f2 and consequently lengthening of the unwound portion of web material. Suction, through the suction holes 13 and the suction box 15, at this point retains the unwound portion of web material adhering to the supporting surface 3 to perform the gluing operation described with reference to FIGS. 1B, 1C, 2B, 2C.

Gluing takes, place causing clockwise rotation (in the drawing) of the movable dispensing element 21 about its own axis of oscillation, which is below the perforated suction portion of the supporting and rolling surface 3. The loose tail end LF unwound from the log R is along the path of the rectilinear portion 21B of the movable dispensing element 21, so that the oscillating movement thereof takes the portion 21B into contact with the outer surface of the web material at the level of the loose tail end LF and, continuing rotation, causes folding of the loose tail end LF on the surface 3, at the level of the suction holes 13, as shown in FIGS. 1B and 2B.

Suction through the holes 13 also retains the loose tail end LF thus folded, thanks to the fact that the web material of which the log R is composed is sufficiently permeable to air. Consequently, during reverse rotation of the movable dispensing element 21, the folded loose end LF, rather than moving backwards due to said reverse rotation, remains in the position in FIG. 1B, with a strip of adhesive A applied by the portion 21B of the movable dispensing element 21 to the surface thereof facing the log R.

After this operation, the roller 5 remains stationary, while the roller 7, the roller 10 and the belts 9 are made to rotate in the direction indicated in FIG. 1C to cause ejection of the log R, which is made to roll between the lower branch of the belts 9 and the tilted and perforated end portion of the supporting and rolling surface 3. The roll R is thus ejected, simultaneously causing closing of the folded end LF on the outer surface of the log R by gluing by the strip of adhesive A. The adhesive A optionally seeps partially through the folded portion of the loose tail end LF to cause slight adhesion also of the outer layer of web material forming the folded end.

The finished log is shown in FIG. 1D. The loose tail end LF is folded and projects with respect to the line of adhesive A applied to the log. This facilitates opening of the log. When the final user grips the folded loose end and detaches it from the roll, the light adhesion caused by seepage of the adhesive on the outermost turn of web material is easily overcome by traction without the material breaking. This allows easy opening of the roll without the risk of the web material tearing along the first and perhaps also the subsequent turns. At the same time, the double thickness of the end, due folding thereof, guarantees the final user a better grip and a sensation of increased volume.

If the folded end is required to be glued up to the end thereof, i.e. up to the point of folding, in the case in FIGS. 1 and 2, the movable dispenser 21, in its movement to return downwards (FIG. 1B) can follow a more flattened trajectory than the one shown, so that the part of adhesive or glue still present on the dispenser wets the stretch of web material folded between the strip of adhesive "A" and the folding line. In this way the remaining filaments of liquid adhesive or glue will be deposited on the part of the web material that will form the end for the final user to grip, guaranteeing very light adhesion of the folded end to the log, to guarantee sufficient seal to avoid problems during subsequent operations (cutting, transport, packaging, etc.) which at the same time does not obstruct gripping and detaching by the final user.

Figure 4A:
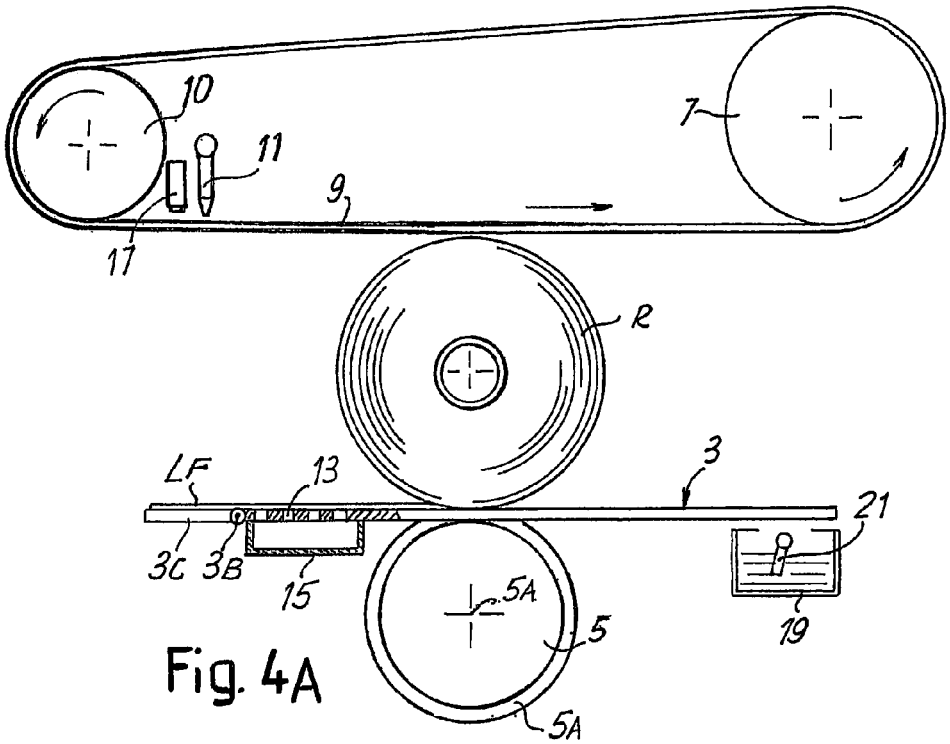
FIGS. 4A, 4B and 4C show a schematic side view of three operating steps of a further device according to the invention.
Figure 4B:
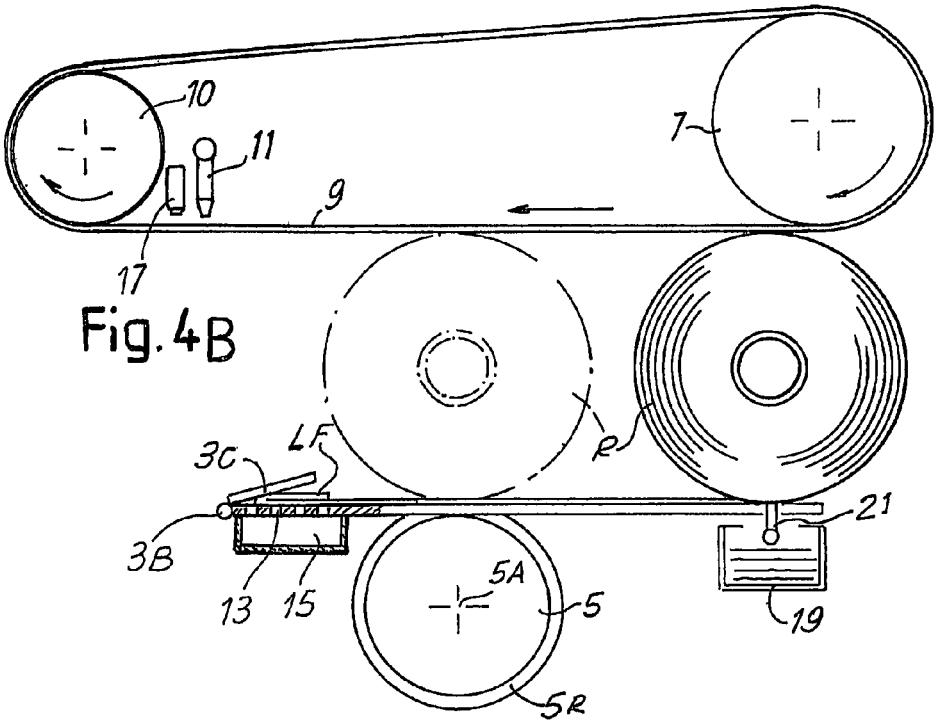
Figure 4C:
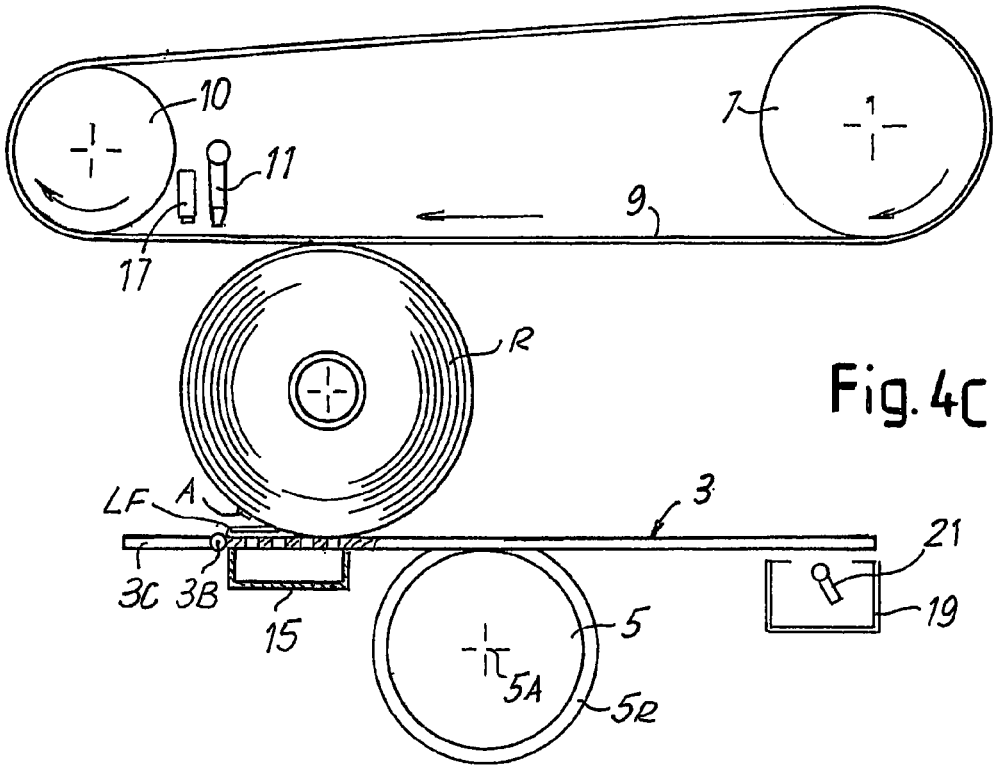

FIGS. 4A, 4B and 4C show, in a schematic side view, a second embodiment of the method and of the device according to the invention. Also in this example of embodiment there is a supporting and rolling surface 3, on which the logs R are fed in a per se known way. Extending parallel to the surface 3 are a series of belts 9 entrained around rollers 7 and 10, while positioned under the supporting surface 3 is a roller 5, again equipped with annular raised portions 5R which project above the surface 3, through profiles defining said surface, or through slots produced in a continuous plate. The end portion of the supporting surface 3 has suction holes 13 in communication with a suction box 15 in the same way as described hereinbefore with reference to the previous example of embodiment.

Positioned along the surface 3 is an adhesive dispenser comprising a reservoir 19 of a liquid adhesive and a movable dispensing element indicated again with 21, in this case equipped with a lifting and lowering movement between a position immersed in the liquid adhesive in the reservoir 19 and a raised position, wherein it is flush with the supporting surface 3 or projects slightly therefrom, through a cross slot.

Provided beyond the perforated suction portion of the surface 3, is a folding plate 3C oscillating about a horizontal axis 3B, parallel to the axis of the logs R.

The device described hereinbefore with reference to FIGS. 4A, 4B and 4C operates as follows. The log R is fed between the lower branch of the belts 9 and the supporting surface 3 and is positioned in the arrangement shown in FIG. 4A, with the loose tail end LF thereof unwound over the plate 3C and the suction portion (equipped with the holes 13) of the supporting and rolling surface. The numeral 17 again indicates the photocell that detects the position of the loose tail end of the log, while nozzles, not shown, similar to those shown at 11 are used to open the loose end with the same procedure as the one described with reference to FIGS. 1 and 2.

The log R is then made to roll, with consequent unwinding of the final portion of web material, until the back thereof is positioned above the glue reservoir 19 (FIG. 4B). The movable dispensing element 21 is raised (optionally in advance with respect to arrival of the log R) to apply adhesive to the back of the log. Simultaneously, or in any case in a moment of time synchronized with application of the adhesive, the folding plate 3C is made to rotate (clockwise in the drawing) about the axis 3B to fold the loose tail end LF over itself (FIG. 4B). The folded loose end LF is retained by suction through the holes 13. Movement of the rollers 7 and 10 and of the belt 9 is then inverted to cause at this point rolling of the log R in the opposite direction, rewinding of the previously unwound portion of web material and closing of the folded loose tail end LF, as well as ejection of the log from the supporting and rolling surface 3. The distance between the suction holes 13 on which the loose tail end LF is folded and the adhesive dispenser is such that the portion of web material unwound is slightly greater than the circumferential extension of the log. In this way, by rewinding the unwound portion of web material, with the tail end LF folded, this covers the strip (continuous or discontinuous) of adhesive applied to the surface of the log, guaranteeing adhesion of the loose end to the log (FIG. 4C).

Positioned beyond the plate 3C, which has been suitably returned to the original position to allow delivery of the glued log R, is, for example, a conveyor belt or other member to remove the log thus sealed. The appearance of the log obtained is again the one illustrated schematically in FIG. 1D.

In a possible alternative to the embodiment in FIGS. 4A-C in place of the dispensing element 21 a series of adhesive dispensing guns or dispensing nozzles can be provided in a position above the log, positioned at intervals between the belts 9 and the pulleys 10, 7. Once the folded tail end of appropriate length is positioned, the guns or nozzles dispense liquid adhesive on the back of the log, which will then be wound again as described above and shown in FIG. 4C.

FIGS. 3A to 3D show a further variant of embodiment of the device and of the method according to the invention. The same numbers indicated the same or equivalent parts to those in the previous examples of embodiment.

The device again has a supporting and rolling surface 3, projecting through which are the annular raised portions 5R of a roller 5 arranged under said surface. Positioned above the surface 3 are the rollers 7 and 10, around which the belts 9 are driven. The end portion of the supporting surface 3 has suction holes 13 in connection with the suction box 15 below.

The end portion of the supporting and rolling surface 3 is again associated with a folding plate 3C oscillating about an axis 3B. Associated with the roller 10 is an oscillating support 31 carrying a duct 33, with which a series of liquid adhesive nozzles 35 is associated.

Figure 3A:
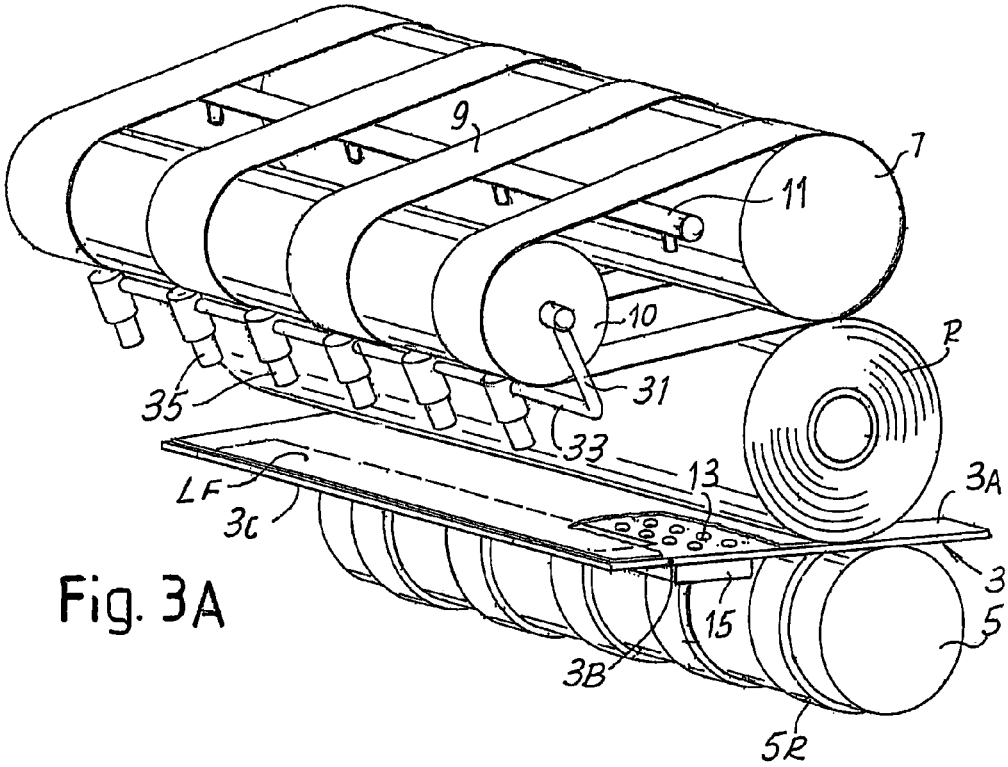
FIGS. 3A, 3B, 3C and 3D show axonometric views of three operating steps of a different embodiment of the device according to the invention.
Figure 3B:
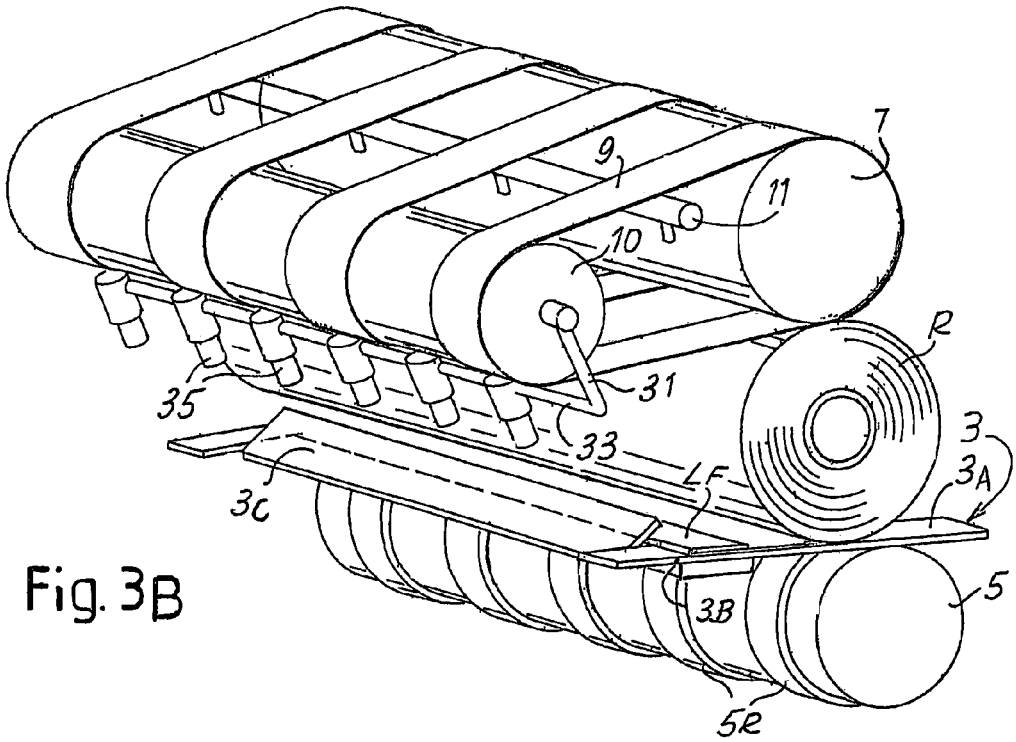
Figure 3C:
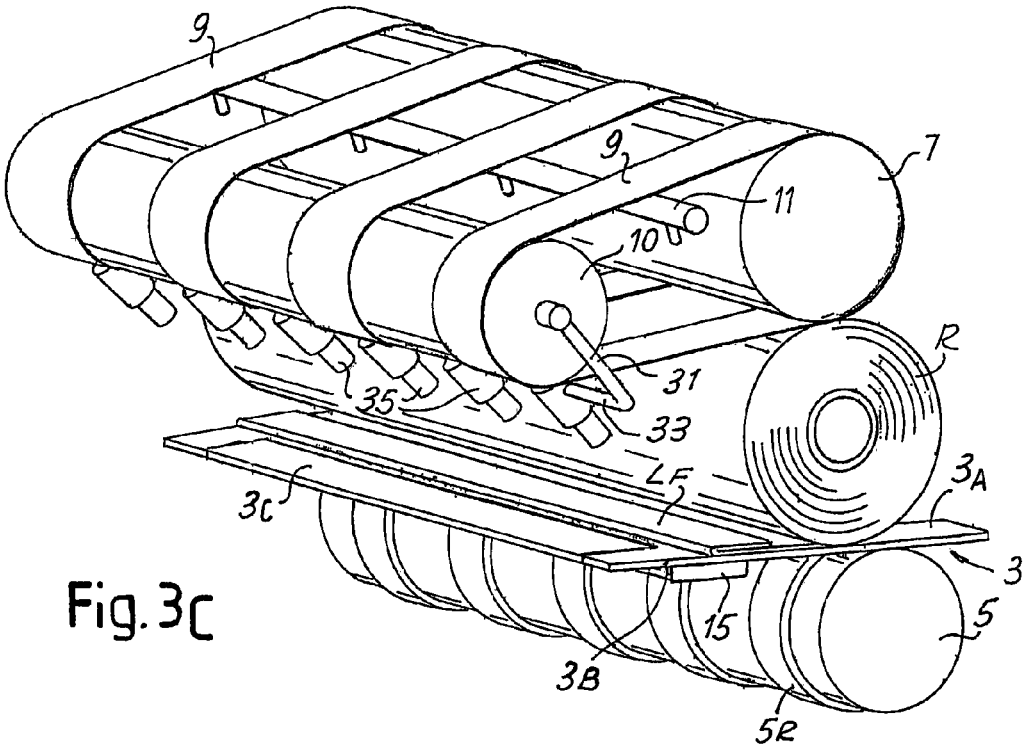
Figure 3D:
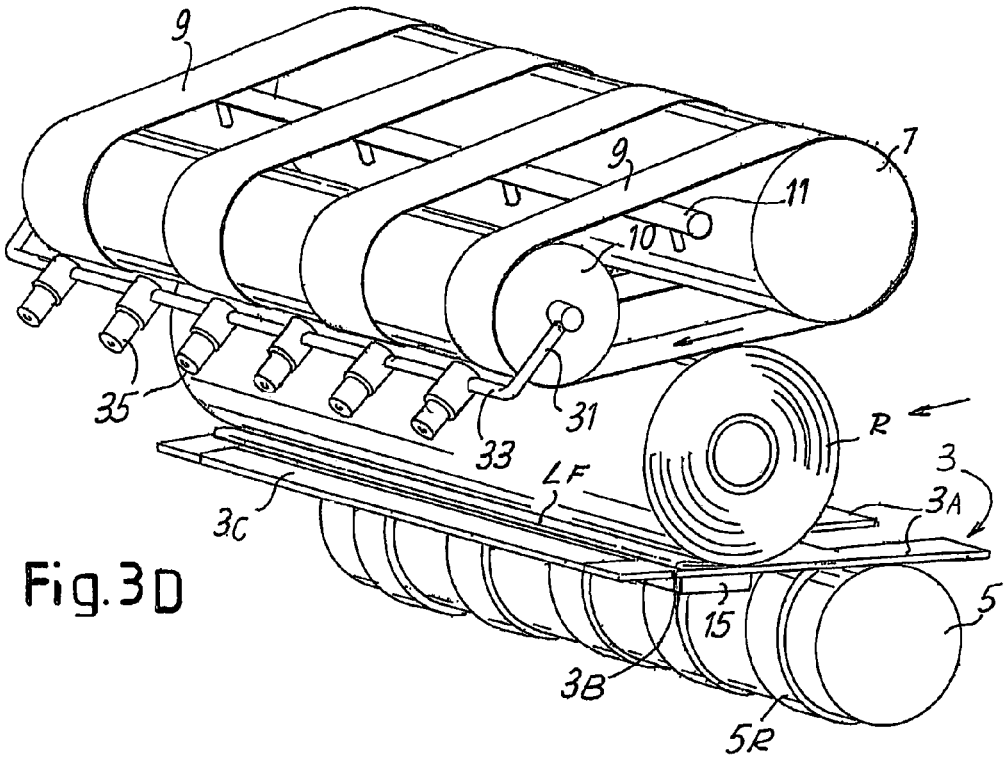

Operation of the device is substantially the same as described hereinbefore with reference to the previous examples of embodiment, with regard to opening and folding of the loose tail end LF of the web material forming the log R, and closing thereof after application of the adhesive. In this case, however, the adhesive is applied by activating the nozzles 35 which spray the necessary quantity of adhesive on the folded surface of the loose tail end LF, after this has reached the position in FIG. 3C. It can be seen how the nozzles 35 are also made to oscillate to be oriented correctly towards the folded loose end to direct the adhesive thereon. Once the adhesive has been applied, the nozzles 35 are withdrawn with respect to the trajectory of the log R, which can be ejected by rotating the rollers 7 and 10 and then moving the belts 9 as shown in FIG. 3D. Alternatively, with appropriate lengths of folded end, the nozzles 35 can direct the jet of glue towards the log, rather than towards the folded end, or towards the nip formed between log and folded end.

Figure 5:
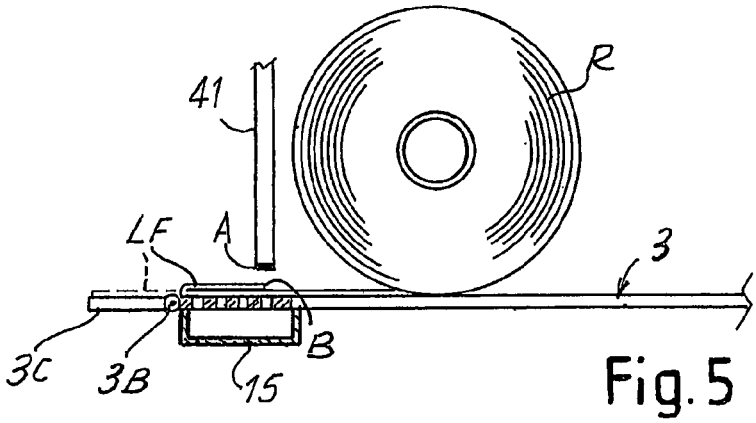
FIG. 5 shows a schematic side view of a further embodiment of the invention.

FIG. 5 shows a variant of embodiment similar to the embodiment in FIGS. 3A to 3D, where nonetheless the adhesive, rather than being composed of a liquid glue, is in the form of a double-sided adhesive tape applied by a generic applicator 41 along the end edge B of the loose tail end LF of the web material unwound from the log R. The position of the piece of double sided adhesive tape is shown in detail in the schematic enlargement in FIG. 6. The double sided adhesive tape is placed overlapping the terminal edge B of the folded loose tail end LF. Rewinding of the folded loose end LF causes adhesion to the back of the log R.

Figure 7A:
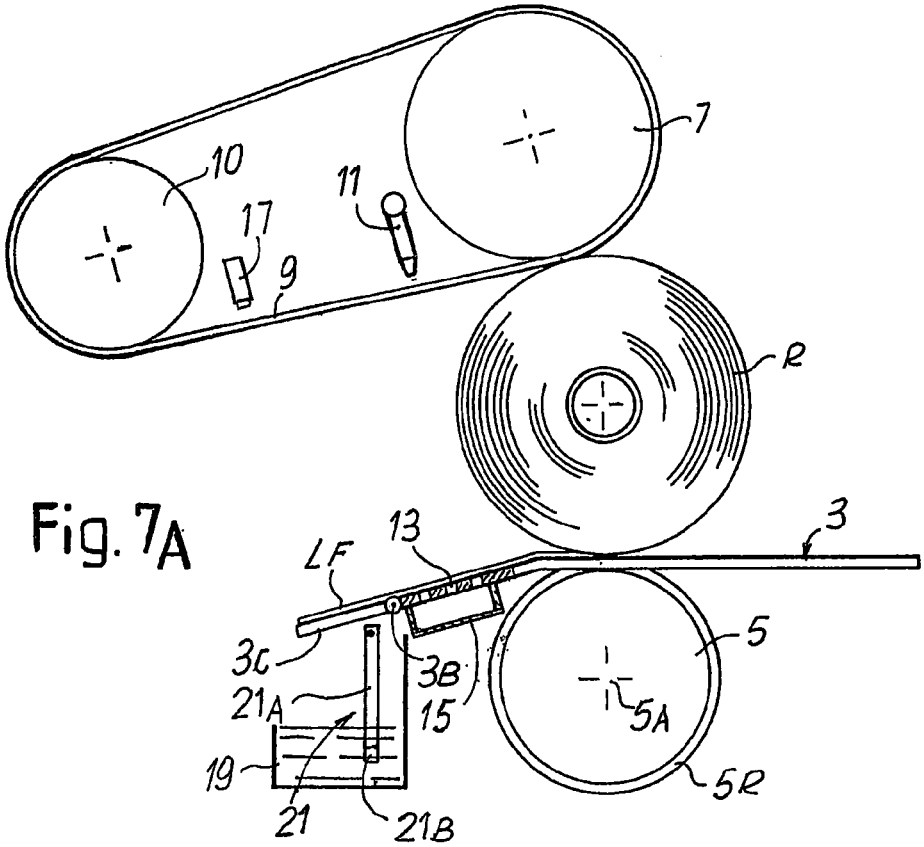
FIGS. 7A, 7B and 7C shows a sequence of the operating cycle of a further device according to the invention.
Figure 7B:
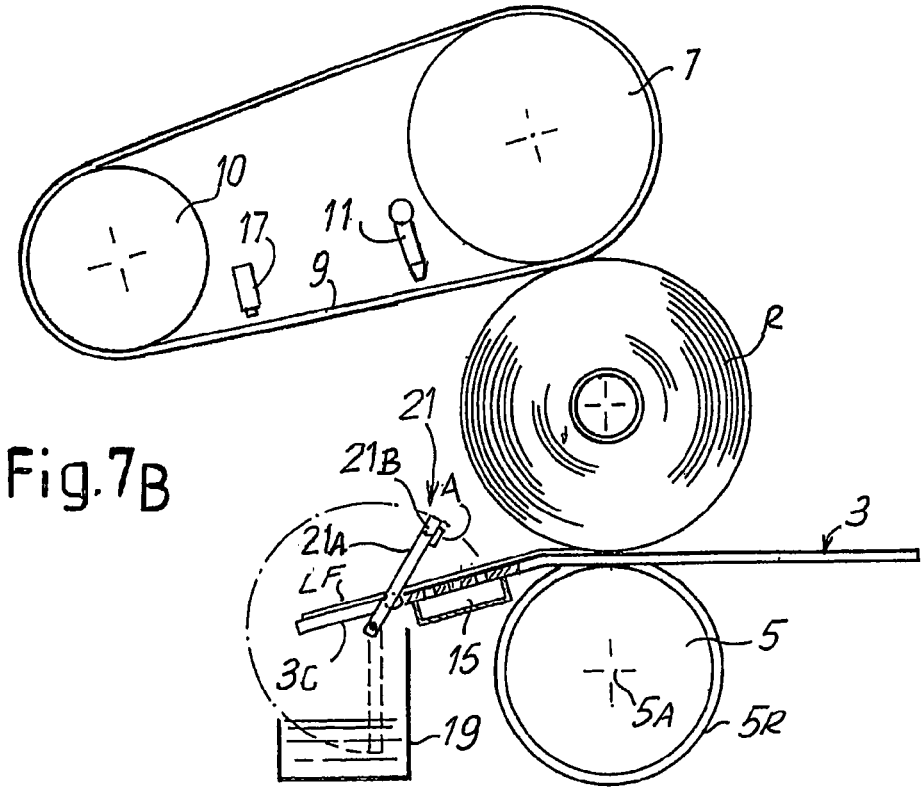
Figure 7C:
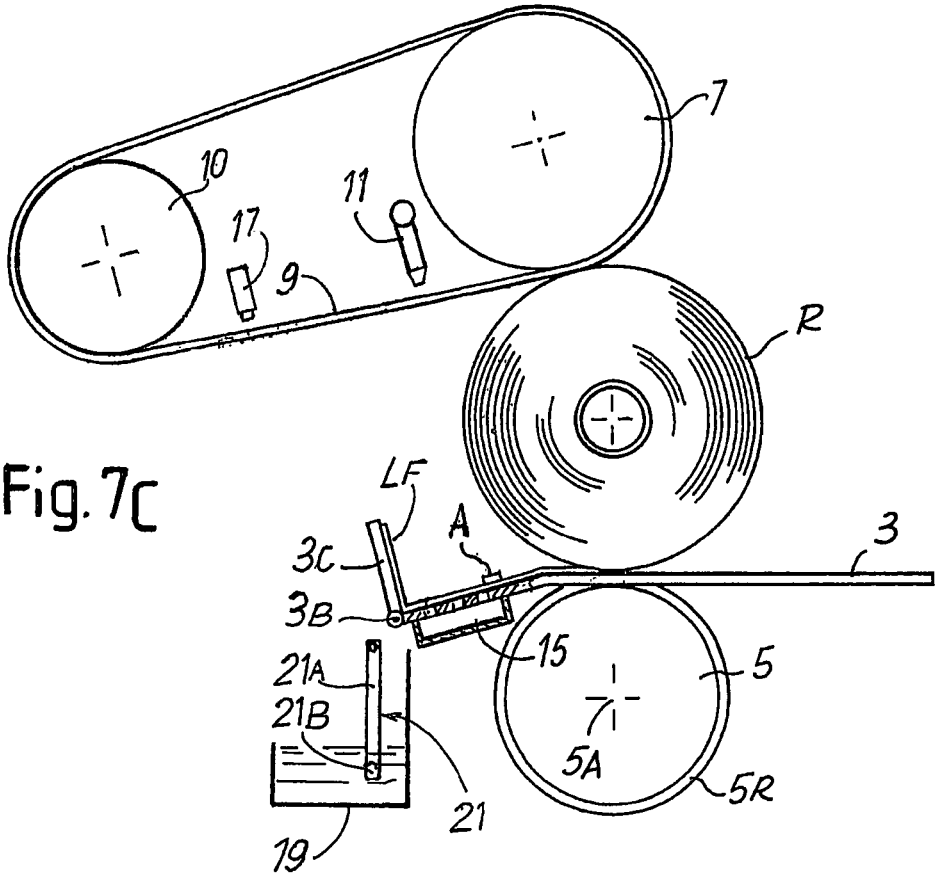
Figure 8:
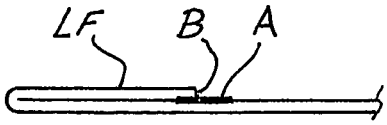
FIG. 8 shows a schematic enlargement of the area for application of the adhesive in the device in FIGS. 7A, 7B and 7C.

FIGS. 7A, 7B and 7C and the enlargement in FIG. 8 show a further variant of embodiment. The same numbers indicate the same or equivalent parts to those in the previous examples of embodiment. In this example the log R is again positioned between the assembly formed by the rollers 7, 10 and by the belts 9 driven therearound and the supporting and rolling surface 3. The annular raised portions 5R of the lower roller 5 project through this surface. The suction holes 13 in connection with the suction box 15 retain the unwound portion of web material and in particular the loose end LF, which is folded by folding of a plate 3C about the axis 3B as shown in the examples in FIGS. 4A to 4C. In this case the liquid glue or adhesive is dispensed by means of a movable dispensing element 21 with a rectilinear portion 21B, hinged oscillatingly about an axis lying below the surface 3. Contrary to the description with reference to FIGS. 1A to 2C, nonetheless, in this case the movable dispensing element 21 is not used to fold over the loose tail end LF, which as stated is folded by the oscillating movement of the plate 3C. The sole function of the movable dispensing element 21 is to apply glue to the surface of the unwound web material facing towards the back of the log.

The arrangement is such that the liquid adhesive picked up by the movable dispensing element 21 in the reservoir 19 is applied at the level of the area in which the terminal or end edge B of the loose end LF will be positioned after folding. FIGS. 7A, 7B and 7C show the operating sequence. In FIG. 7A, the loose end LF is positioned by means of the operations already described and with the use of the photocell 17 and air nozzles; in FIG. 7B the movable dispensing element 21 transfers the adhesive A to the desired position on the inner surface of the unwound portion of web material; in FIG. 7C the loose end LF is folded, i.e. folded over against the inner surface of the remaining portion of unwound web material and is positioned with the end edge B approximately in the center of the strip of adhesive A applied previously, as shown in the schematic enlargement in FIG. 8. Subsequent rolling of the log R allows ejection of said log and closing thereof through rewinding of the previously unwound portion of web material.

Figure 1B:
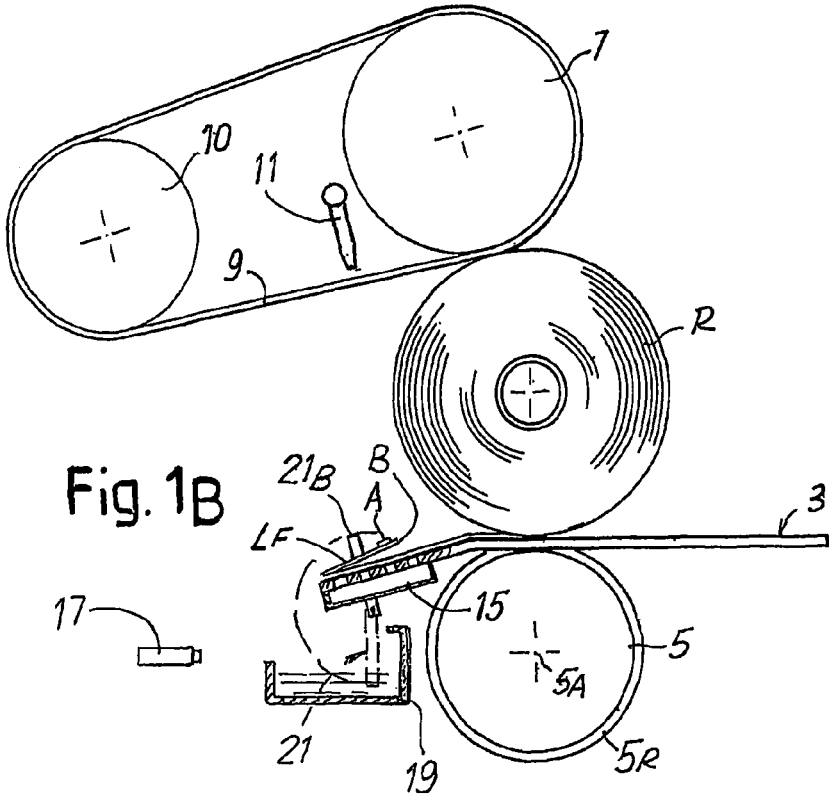
Figure 2A:
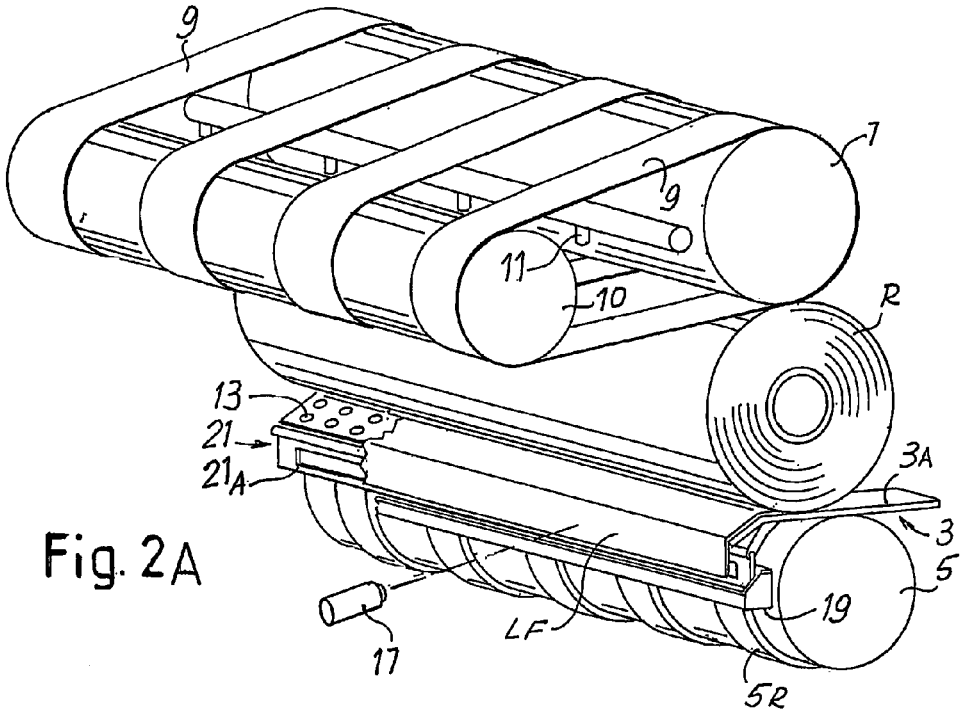
FIGS. 2A, 2B and 2C show axonometric views of the device in Figures 1A, 1B and 1C in three steps of the process to close the tail end.
Figure 2B:
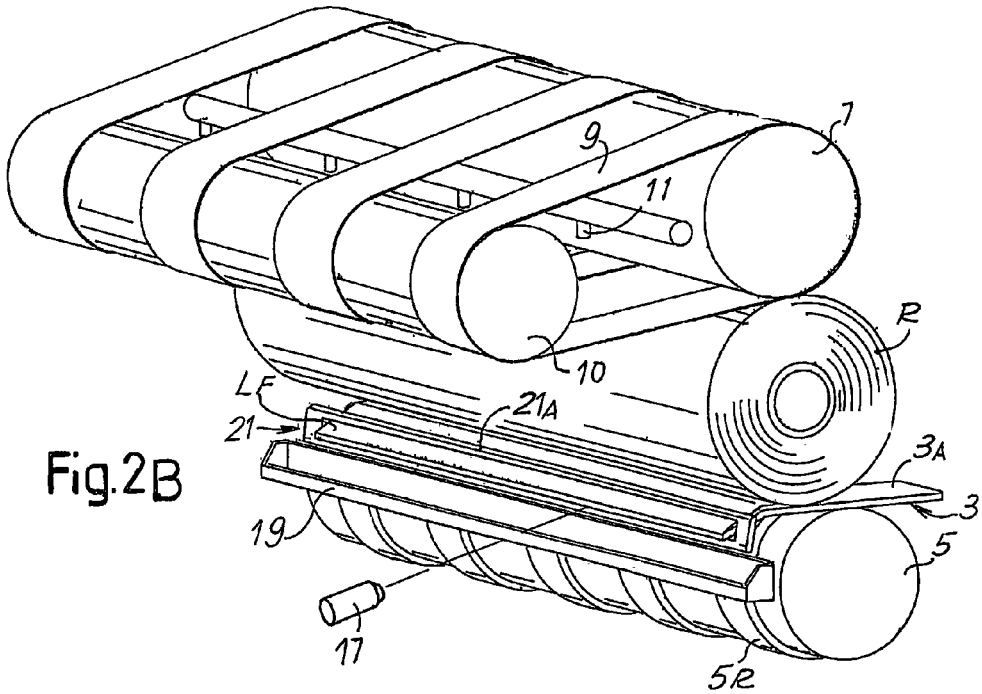
Figure 2C:
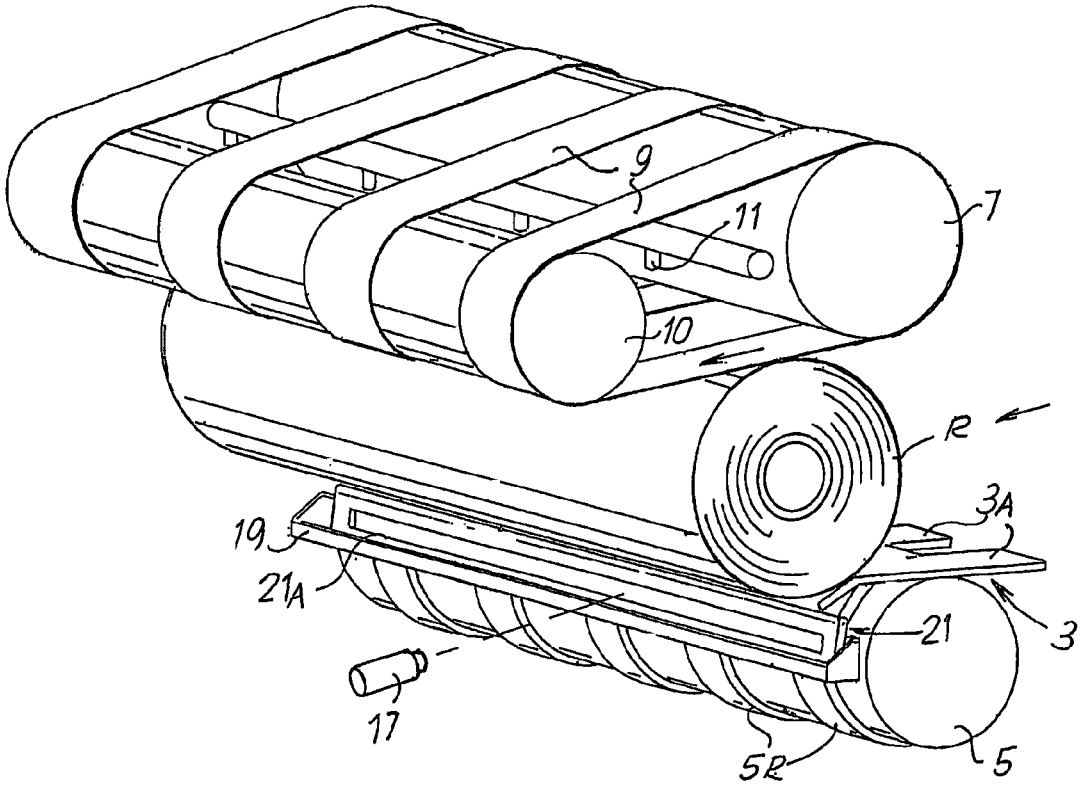
Figure 9A:
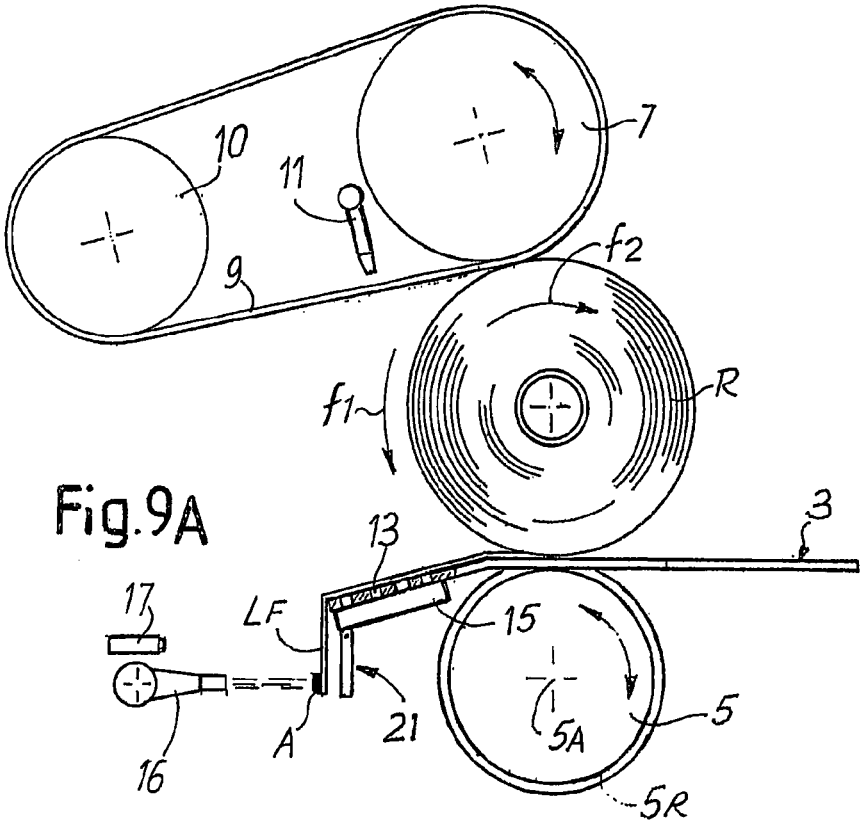
FIGS. 9A and 9B show a variant of embodiment in two moments of the operating cycle.
Figure 9B:
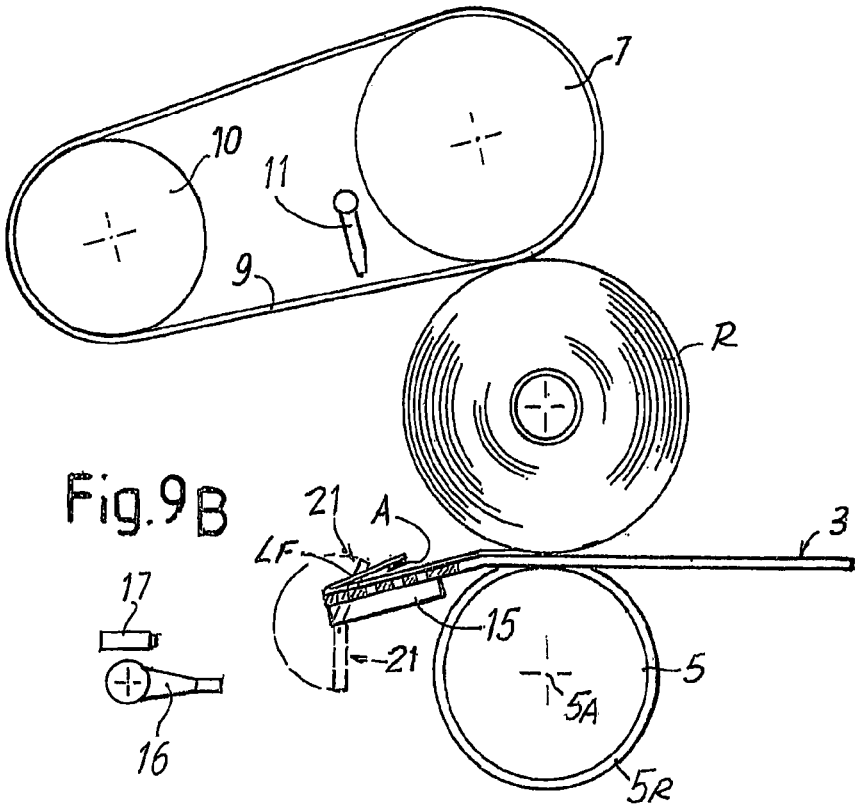

FIGS. 9A and 9B show two operating steps of a device in a further embodiment, which forms a variant with respect to that illustrated in FIGS. 1A-1C. The same numbers indicate the same or equivalent parts to those in the. example of embodiment in FIGS. 1A-1C. In this example of embodiment, the adhesive is applied by a series of dispensing nozzles 16 positioned in the vicinity of the photocells 17 and optionally aligned and alternated therewith. Once the terminal end has been detected the dispensing nozzles 16 dispense adhesive on the loose end, as shown in FIG. 9A. The end, folded as shown in FIG. 9B by the oscillating element 21 (which in this case does not function as adhesive applicator), is glued to the inner surface of the web material. Part of the adhesive seeps through the thickness of the folded web material and causes the surface of the loose tail end facing the axis of the log to adhere to the surface of said log.

In all the cases illustrated it is possible to distribute the glue or adhesive in a strip or complete area, or in stretches or limited areas. In particular, in the examples in FIGS. 3, 4, 5 and 6, the glue or adhesive can be distributed in restricted stretches or areas. In all these cases the folded end can be sealed up to the folding line, while remaining easy for the final user to grip and detach. It is sufficient that the adhesive, for example in the configuration shown in FIG. 3, although sprayed up to the folding line, is not distributed over the entire surface, i.e. allows, for example, a finger to be inserted between two adjacent glued areas in the finished roll, so that the final user can grip the tail end and lift it from the wound roll.

Figure 6:
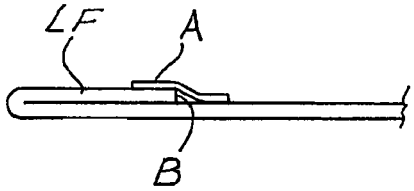
FIG. 6 shows a schematic enlargement of the area for application of the adhesive in the device in FIG. 5.

Similarly, in the example in FIGS. 5 and 6, it is sufficient that the double-sided adhesive tape "A" is distributed in short stretches and with the left-hand part in FIG. 6 extended up to the folding line.

Also similarly, in the example in FIG. 4 the dispenser can distribute adhesive according to broken stretches "A", instead of in the form of a continuous line.

In all these cases (adhesive in stretches or in areas), by suitably staggering the areas provided with adhesive with the cut of the logs into rolls of appropriate length, it is possible to make the glued areas coincide with those without glue, with the side and central parts of each roll respectively (or vice versa), to obtain rolls which offer the final user areas to grip and lift the tail end in the center or on the side parts of said roll, respectively.

Figure 10:
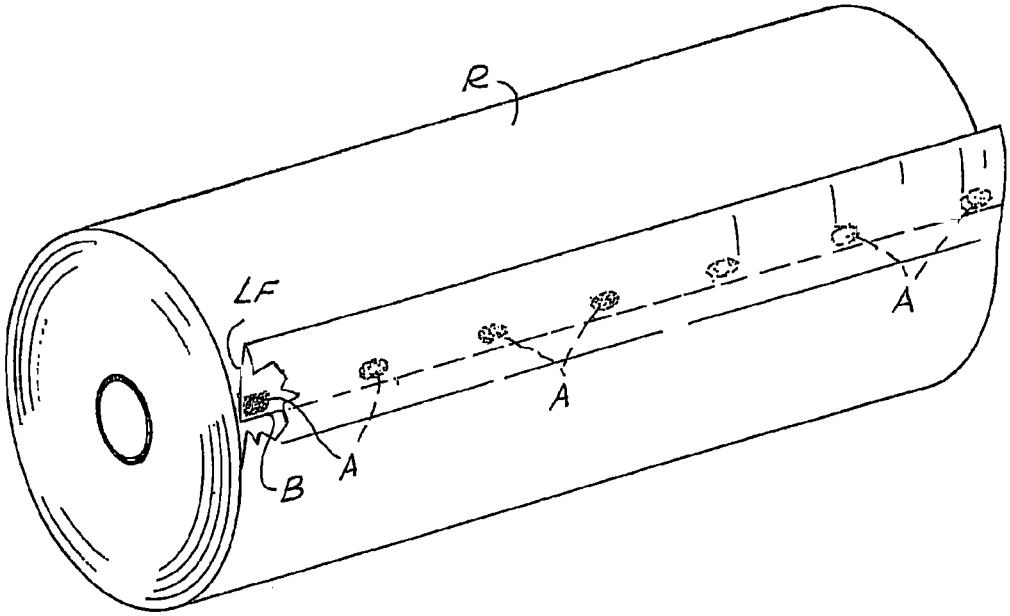
FIG. 10 schematically shows a log in a different configuration, with discontinuous distribution of the glue.

FIG. 10 schematically shows a portion of a roll or log glued according to this method, i.e. with areas of glue or adhesive spaced from one another, which leave loose portions of web material that can be gripped easily to facilitate detachment from the roll. The discrete areas, aligned along a line parallel to the axis of the log, at the level of which the adhesive is applied, are indicated schematically with A.

It is understood that the drawing merely shows possible examples of embodiment of the invention, which can vary in forms and arrangements without however departing from the scope of the concept on which said invention is based. Any reference numerals in the appended claims are provided to facilitate reading of the claims with reference to the description and to the drawing, and do not limit the scope of protection represented by the claims.

The invention claimed is:

1. A method for closing a tail end of a log of web material using an adhesive, comprising steps of: unwinding a portion of web material from the log; applying said adhesive; rewinding said portion of web material to make the tail end adhere to the log, wherein said tail end is folded before said rewinding to form a folded end of web material which includes a portion for gripping and detaching the folded end from the log; wherein said adhesive is dispensed at a level of a supporting surface of the log; and wherein said adhesive is applied by a movable dispensing element, which picks up said adhesive from a container and applies the adhesive to the portion of web material unwound.

2. The method as claimed in claim 1, wherein the folded end of the web material projects beyond the adhesive when the tail end has been rewound on the log.

3. The method as claimed in claim 1, wherein said tail end is folded on an inner surface of the portion of said web material unwound, an end edge of the tail end being positioned inside a last turn of the web material wound on the log.

4. The method as claimed in claim 2, wherein said tail end is folded on an inner surface of the portion of said web material unwound, an end edge of the tail end being positioned inside a last turn of the web material wound on the log.

5. The method as claimed in claim 1, wherein said adhesive is applied to the tail end of the web material, in proximity to a terminal edge thereof, on a surface that comes into contact with the web material forming the log when said portion of web material is rewound.

6. The method as claimed in claim 1, including steps of: unwinding said portion of web material a length exceeding one turn; applying said adhesive to an area of web material still wound on the log; after having folded said tail end, rewinding the portion of web material unwound to cover the adhesive applied to the log with the folded end.

7. The method as claimed in claim 3, wherein said adhesive is applied to an area of the portion of web material unwound from the log, the tail end being folded on said area, adhesion of the tail end being obtained by seepage of the adhesive through the folded end.

8. The method as claimed in claim 1, wherein said adhesive is applied to an area of the portion of web material unwound from the log, the tail end being folded on said area, adhesion of the tail end being obtained by seepage of the adhesive through the folded end.

9. The method as claimed in claim 3, wherein the adhesive is applied at a level of a position taken by a terminal edge of the folded end, on a band extending crosswise to a longitudinal extension of the web material, on both sides of said terminal edge of the folded end.

10. The method as claimed in claim 1, wherein the adhesive is applied at a level of a position taken by a terminal edge of the folded end, on a band extending crosswise to a longitudinal extension of the web material, on both sides of said terminal edge of the folded end.

11. The method as claimed in claim 1, wherein said adhesive is a liquid glue.

12. The method as claimed in claim 1, wherein said adhesive is applied by said movable dispensing element, extending parallel to an axis of the log with movement towards the tail end of the log, said dispensing element applying the adhesive and folding the tail end.

13. The method as claimed in claim 1, wherein said tail end is folded with a folding member and said adhesive is applied by a dispensing element separate from the folding member.

14. The method as claimed in claim 1, wherein said adhesive is distributed discontinuously.

15. A device for closing a tail end of a log of web material, comprising a system for unwinding a portion of web material from the log and a system for rewinding the tail end on the log after application of an adhesive, including a folding member to fold the tail end and form a fold of web material defining a portion for gripping and detaching a loose end of the fold of web material from the log; wherein said folding member comprises an adhesive dispensing element, which during movement thereof applies adhesive to the tail end and causes folding thereof.

16. The device as claimed in claim 15, wherein the folding member is constructed and arranged to form the loose end of the fold of web material so as to project beyond the adhesive after the tail end has been rewound and adhered to the log.

17. The device as claimed in claim 15, wherein said folding member is constructed and arranged to fold the tail end of the log on an inner surface of said portion of web material unwound, to position a terminal edge of the tail end inside a last turn of web material wound on the log.

18. The device as claimed in claim 16, wherein said folding member is constructed and arranged to fold the tail end of the log on an inner surface of said portion of web material unwound, to position a terminal edge of the tail end inside a last turn of web material wound on the log.

19. The device as claimed in claim 15, wherein said dispensing element is equipped with an oscillatory movement between a position of immersion in a container of liquid adhesive and a position of folding over of the tail end.

20. The device as claimed in claim 15, further comprising a supporting surface for the log, with an end with which said folding member is associated.

21. The device as claimed in claim 20, wherein said dispensing element is positioned at a level of an end of the supporting surface of the log and is constructed and arranged to have oscillatory movement along a path which intercepts the loose end of the web material when such projects beyond the end of said supporting surface, the path terminating against said supporting surface, on which the dispensing element folds over the tail end of the web material, an axis of oscillation of the dispensing element being on an opposite side of said supporting surface with respect to the web material.

22. The device as claimed in claim 20, wherein an adhesive dispenser, which applies adhesive to an outer surface of the log, is positioned along said supporting surface.

23. The device as claimed in claim 20 or 21, wherein said supporting surface has a suction portion to retain the fold of web material formed from the tail end.

24. The device as claimed in claim 20, further comprising devices to cause controlled rolling of the log along the supporting surface and members to open the loose end, to position the loose end for application of the adhesive, wherein said devices and said members are positioned along said supporting surface of the logs.

25. The device as claimed in claim 24, wherein said devices to cause controlled rolling comprise at least one flexible member parallel to at least one portion of said supporting surface, with a path for passage of the log extending between the supporting surface and said flexible member.

26. The device as claimed in claim 24, wherein said devices to cause controlled rolling of the log comprise a pair of rollers.

27. The device as claimed in claim 26, wherein a first roller of said pair of rollers is positioned with an axis thereof on one side of the supporting surface, the path for passage of the log passing between said first roller and said supporting surface, and a second roller of said pair of rollers is positioned with an axis thereof on an opposite side of the supporting surface and projects from said supporting surface towards the path of the log.

28. The device as claimed in claim 20, wherein said supporting surface comprises two flat portions is tilted in relation to each other.

29. The device as claimed in claim 20, including an adhesive applicator to apply said adhesive discontinuously.

30. A device for closing a tail end of a log of web material, comprising a system for unwinding a portion of web material from the log and a system for rewinding the tail end on the log after application of an adhesive, including a folding member to fold the tail end and form a fold of web material defining a portion for gripping and detaching a loose end of the fold of web material from the log; and an adhesive dispensing element, which during movement thereof applies adhesive to the tail end; said adhesive dispensing element being equipped with an oscillatory movement between a position of immersion in a container of liquid adhesive and a position of adhesive application on the tail end.

31. The device as claimed in claim 30, further comprising a supporting surface for the log, with an end with which said folding member is associated.

32. The device as claimed in claim 31, wherein said dispensing element is positioned at an end of the supporting surface of the log and is constructed and arranged to have oscillatory movement along a path which intercepts the loose end of the web material when such projects beyond the end of said supporting surface, the path terminating against said supporting surface, on which the dispensing element folds over the tail end of the web material, an axis of oscillation of the dispensing element being on an opposite side of said supporting surface with respect to the web material.

33. The device as claimed in claim 31, wherein said end of the supporting surface of the log is foldable to fold the tail end of the web material.

34. The device as claimed in claim 33, wherein said adhesive dispenser is associated with said foldable end of each surface.

35. The device as claimed in claim 30, wherein said movable dispensing element is constructed and arranged to apply the adhesive to a surface of the folded end facing towards the log.

36. The device as claimed in claim 30, wherein said movable dispensing element is constructed and arranged to apply the adhesive to a surface of an unwound portion of the web material at a level of a terminal edge of the fold of web material, before folding said tail end.

37. The device as claimed in claim 31, 32, 33 or 34, wherein said supporting surface has a suction portion to retain the fold of web material formed from the tail end.

38. The device as claimed in claim 31, further comprising devices to cause controlled rolling of the log along the supporting surface and members to open the loose end, to position the loose end for application of the adhesive, wherein said devices and said members are positioned along said supporting surface of the logs.

* * * * *

UNITED STATES PATENT AND TRADEMARK OFFICE

CERTIFICATE OF CORRECTION

PATENT NO. : 7,846,286 B2
APPLICATION NO. : 11/794091
DATED : December 7, 2010
INVENTOR(S) : Mauro Gelli It is certified that error appears in the above-identified patent and that said Letters Patent is hereby corrected as shown below:

On the Title Page, Item "(86)...." should read

-- [86] PCT No.: PCT/IT2005/000766
§371 (c)(1),
(2), (4) Date: July 9, 2007 --.

Column 5,
Line 1, "Gluing takes, place" should read -- Gluing takes place --.

Column 11,
Claim 28, Line 2, "two flat portions is tilted" should read -- two flat portions tilted --.

Signed and Sealed this
Eighteenth Day of October, 2011

David J. Kappos

David J. Kappos
*Director of the United States Patent and Trademark Office*